US007366659B2

(12) United States Patent
Etter

(10) Patent No.: US 7,366,659 B2
(45) Date of Patent: Apr. 29, 2008

(54) METHODS AND DEVICES FOR SELECTIVELY GENERATING TIME-SCALED SOUND SIGNALS

(75) Inventor: Walter Etter, Wayside, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 743 days.

(21) Appl. No.: 10/163,356

(22) Filed: Jun. 7, 2002

(65) Prior Publication Data

US 2003/0229490 A1 Dec. 11, 2003

(51) Int. Cl.
*G10L 11/00* (2006.01)

(52) U.S. Cl. ..... 704/211; 704/206

(58) Field of Classification Search ..... None
See application file for complete search history.

(56) References Cited

U.S. PATENT DOCUMENTS

| | | | | |
|---|---|---|---|---|
| 4,246,617 | A | 1/1981 | Portnoff | |
| 4,864,620 | A | 9/1989 | Bialick | |
| 5,630,013 | A * | 5/1997 | Suzuki et al. | 704/216 |
| 5,699,404 | A | 12/1997 | Satyamurti et al. | |
| 5,828,994 | A | 10/1998 | Covell et al. | |
| 5,828,995 | A | 10/1998 | Satyamurti et al. | |
| 6,049,766 | A | 4/2000 | Laroche | |
| 6,519,567 | B1 * | 2/2003 | Fujii | 704/503 |

FOREIGN PATENT DOCUMENTS

WO WO 00/13172 3/2000

OTHER PUBLICATIONS

J. Laroche "Improved Phase Vocoder Time-Scale Modification of Audio" IEEE Trans-on Speech and Audio Proc., vol. 7, No. 3, pp. 323-332, May 1999.

J. Laroche, M. Dolson "New phase -Vocoder Techiniques for Real Time pitch shifting . . . " Jaudis.SOC., vol. 47, No. 11, Nov. 1999.

E. Moulines, J. Laroche, "Non-Parametric techniques for pitch-scale and time scale modification of Speech" Speech Comm'n., vol. 16 pp. 175-205, Feb. 1995.

H.Valbert, E.Moulines "Voice Transformation Using PSOLA technique," Speech Communication, vol. 11, pp. 175-187, 1992.

E. Moulines, J Laroche, "Non-parametric Techniques for pitch." speech communication, vol. 16, pp. 175-205, 1995.

(Continued)

*Primary Examiner*—Abul K. Azad

(57) ABSTRACT

Time-scaled, sound signals (i.e. sounds output at differing speeds) are generated by mixing weighted time-and frequency-domain processed signals, the former signal generally representing speech-based signals while the latter representing music-based signals. The weights applied to each type of signal may be determined by a scaling factor, which in turn is related to the desired speed at which a listener desires to hear a sound signal. In one example of the invention, only stationary signal portions of an input sound signal are used to generate time-scaled processed signals. An adaptive frame-size may also be used to pre-process the separate signals prior to being weighted, which at least decreases the amount of unwanted reverberative sound qualities in a resulting sound signal. Together, techniques envisioned by the present invention produce improved, speed adjusted sound signals.

27 Claims, 1 Drawing Sheet

OTHER PUBLICATIONS

H. Weinrichter, E Brazda "Time Domain Compression and expansion . . . " Signal Proc.III Young et al. EVRASIP, pp. 485-488, 1986.
J.L. Flanagan, R.M. Golden, "Phase Vocoder," The Bell System Techn. J., pp. 1493-1509, Nov. 1966.
T.F. Quartieri" Shape Invariant Time-Scale and pitch" IEEE, vol. 40, No. 3 pp. 497-510, Mar. 1992.

* cited by examiner

METHODS AND DEVICES FOR SELECTIVELY GENERATING TIME-SCALED SOUND SIGNALS

BACKGROUND OF THE INVENTION

Sometimes it is desirable to control the speed at which a sound recording is played, such as messages played back using an answering machine or service; messages received using a network device (e.g., Internet based audio streaming); in speech learning tools for the hard of hearing and hearing aids; and in tape recorders and the like.

Conventional methods for processing sound signals whose speed has been altered are based on either time-domain or frequency-domain techniques. In general, time-domain techniques are used to process sounds generated from conversations or speech while frequency-domain techniques are used to process sounds generated from music. Efforts to use time-domain techniques on music have resulted in less than satisfactory results because music is "polyphonic" and, therefore, cannot be modeled using a single pitch, which is the underlining basis for time-domain techniques. Likewise, efforts to use frequency-domain techniques to process speech have also been less than satisfactory because they add a reverberant quality, among other things, to speech-based signals.

Attempts have been made to minimize the side-effects of frequency-domain techniques but they have resulted in limited improvements in sound quality. See for example, J. Laroche, "Improved phase vocoder time-scale modification of audio," IEEE Trans. on Speech and Audio Proc., Vol. 7, no. 3, pp. 323-332, May 1999.

Other advances, mainly in time-domain based, time-scaling techniques have used the fact that speech signals can be separated into various types of signal "portions" those being "non-stationary" (sounds such as 'p', 't', and 'k') and "stationary" portions (vowels such as 'a','u','e' and sounds such as 's', 'sh'). Conventional time-domain systems process each of these portions in a different manner (e.g., no time-scaling for short non-stationary portions). See for example E. Moulines, J. Laroche, "Non-parametric techniques for pitch-scale and time-scale modification of Speech", Speech Commun., vol 16, pp. 175-205, February 1995. However, similar alterations of the time-scaling process based on the stationary features of a sound signal have not yet found their way into frequency-domain systems. As in time domain systems, frequency-domain systems should process non-stationary signal portions in a different manner than stationary portions in order to achieve improvements in sound quality.

For example, time-domain systems process non-stationary portions in small increments (i.e., the entire portion is broken up into smaller amounts so it can be analyzed and processed) while stationary portions are processed using large increments. The phrase "frame-size" is used to describe the number of signal samples that are processed together at a given time.

Conventional frequency-domain techniques use a fixed frame-size and do not alter the frame-size based on signal characteristics. By failing to alter the frame size or to otherwise vary the type of time-scaling used to process non-stationary signal portions, sound quality is sacrificed.

Accordingly, it is desirable to provide methods and devices for selectively generating time-scaled sound signals in order to provide improvements in sound quality.

It is a further desire of the present invention to provide methods and devices for selectively generating sound signals which combine the advantages of both time and frequency-domain processed signals.

It is yet an additional desire of the present invention to provide methods and devices for removing unwanted reverberant sound qualities in frequency-domain processing.

Further desires of the present invention will be apparent from the drawings, detailed description of the invention and claims which follow.

SUMMARY OF THE INVENTION

Figure 1:
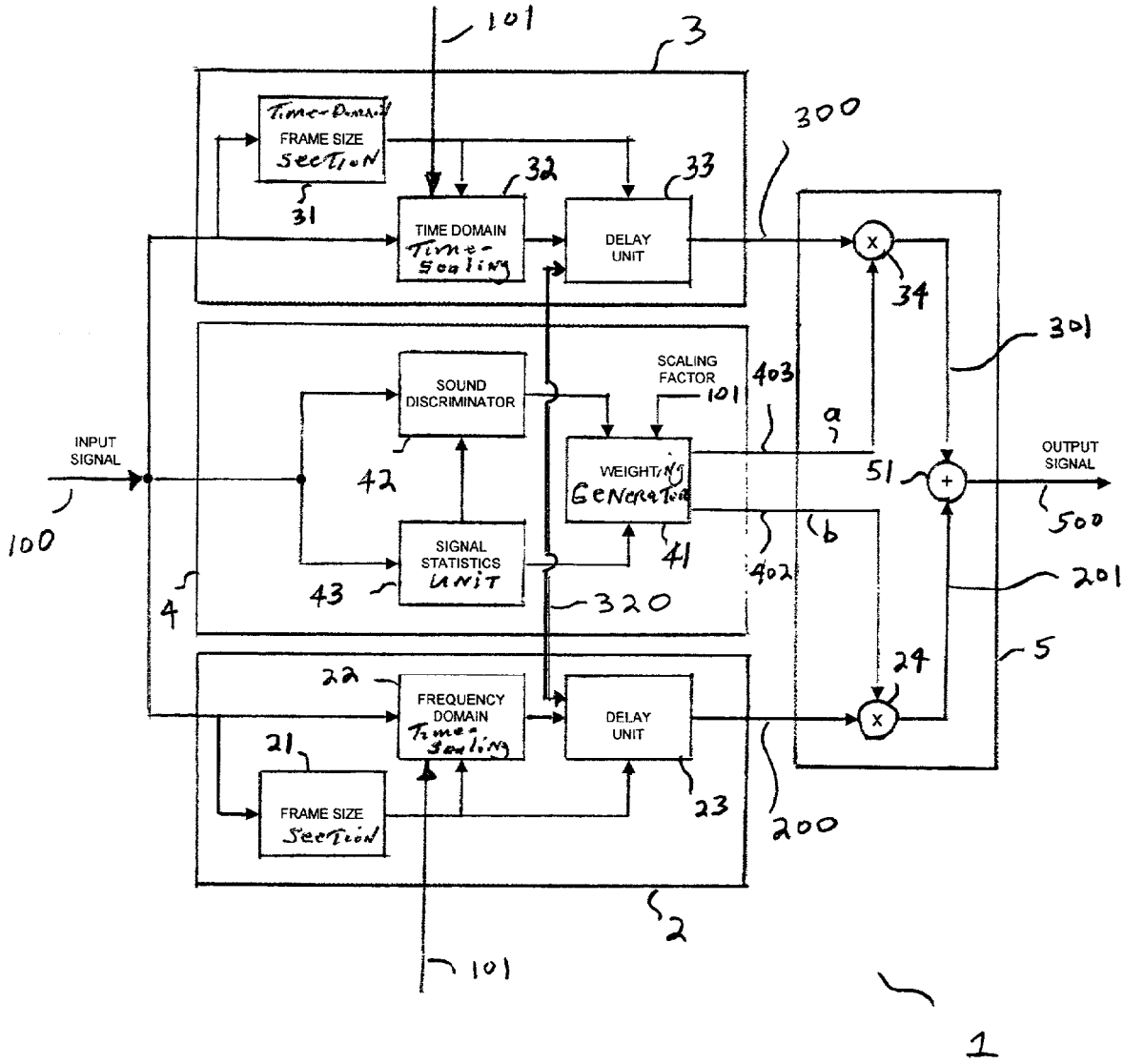
FIG. 1 depicts a simplified block diagram of techniques for generating speed adjusted, sound signals using both time-domain and frequency-domain, time-scaled signals according to embodiments of the present invention.

In accordance with the present invention there are provided techniques for selectively generating speed adjusted, sound signals (i.e., time-scaled signals) using both time and frequency-domain processed, time-domain, time-scaled signals one of which comprises: a control unit adapted to generate first and second weights from an input sound signal (e.g., music or speech); a time-domain processor adapted to generate a time-domain processed, time-domain, time-scaled signal ("first signal"); a frequency-domain processor adapted to generate a frequency-domain processed, time-domain, time-scaled signal ("second signal"); and a mixer adapted to adjust the first signal using the first weight, adjust the second signal using the second weight, combine the so adjusted signals and for outputting a time-scaled, sound signal. In a further embodiment of the present invention, the control unit can be adapted to adjust the first and second weights based on a scaling factor. By so adapting the weights the correct contribution from each processed signal (i.e., correct balance between time-domain and frequency-domain processed signals) is used depending on the type of sound signal input.

In addition, the present invention provides for selectively applying time-scaling to only the stationary portions of an input sound signal and for making use of a frame-size which is adapted to the portion (i.e., stationary or non-stationary) of a signal being processed (referred to as an "adaptive frame-size", for short) in order to further improve the sound quality of a speed-adjusted signal.

DETAILED DESCRIPTION OF THE INVENTION

Referring to FIG. 1, there is shown a simplified block diagram of a technique which generates sound signals using both time and frequency-domain processed signals, processes stationary and non-stationary portions of a sound signal differently and makes use of an adaptive frame-size according to embodiments of the present invention. As shown, a device 1 comprises frequency-domain processor 2, time-domain processor 3, control unit 4 and mixer 5. In one embodiment of the present invention, each of these elements are adapted to operate as follows. Upon receiving an input sound signal via pathway 100 the control unit 4 is adapted to generate first and second weights (i.e., electronic signals or values which are commonly referred to as "weights") from the input sound signal and a scaling factor input via pathway 101. The weights, designated as a and b, are output via pathways 402 and 403 to the mixer 5.

The input sound signal is also input into the processors 2,3. The time-domain processor 3 is adapted to generate and output a time-domain processed, time-scaled signal ("first signal") via pathway 300 to mixer 5. Frequency-domain processor 2 is adapted to: transform a time-domain signal into a frequency domain signal; process the signal; and then convert the signal back into a time-domain, time-scaled signal. Thereafter, processor 2 is adapted to output this frequency-domain processed, time-domain, time-scaled signal ("second signal") via pathway 200 to the mixer 5. Upon receiving such signals from the processors 2,3 the mixer 5 is adapted to apply the first weight a to the first signal and the second weight b to the second signal in order to adjust such signals. Mixer 5 is further adapted to combine the so adjusted signals and then to generate and output a time-scaled, sound signal via pathway 500.

In this way, the present invention envisions combining both time-domain and frequency-domain processed signals in order to process both speech and music-based, input sound signals. By so doing, the limitations described previously above are minimized.

Operation of the control unit 4 and processors 2,3 will now be described in more detail. As shown, the control unit 4 comprises a sound discriminator 42, signal statistics unit 43 and weighting generator 41. Upon input of a sound signal via pathway 100 the discriminator 42 and signal statistics unit 43 are adapted to determine whether the input signal is a speech or music-based signal. Thereafter, the weighting generator 41 is adapted to generate weights a and b. As envisioned by the present invention, if the signal is a speech signal the value of the weight a will be larger than the value of the weight b. Conversely, if the input signal is a music signal the value of the weight b will be larger than the value of the weight a. In effect, the weights a and b determine which of the signals 200,300 will have a bigger influence on the ultimate output signal 500 heard by a user or listener. In this manner, the control unit 4 balances the use of a combination of the first signal 300 and second signal 200 depending on the type of sound signal input into device 1.

Continuing, suppose a user (i.e., listener) of device 1 wishes to vary the speed of the speech or music signal he or she is listening to. Enter the scaling factor. It is the scaling factor which acts to adjust the speed at which the signal is heard. As envisioned by the present invention, the control unit 4 is adapted to adjust the first and second weights a and b based on the scaling factor input via pathway 101.

Before continuing, it should be noted that the scaling factor input via pathway 101 may be manually input by a user or otherwise generated by a scaling factor generator (not shown).

According to one embodiment of the present invention, as the value of the scaling factor increases the control unit 4 is adapted to increase the second weight b and decrease the first weight a. Conversely, as the value of the scaling factor decreases the control unit 4 is further adapted to decrease the second weight b and increase the first weight a. This adjustment of weights a and b based on a scaling factor is done in order to select the proper "mixing" of signals 200,300 generated by processors 2,3. In other words, if the value of weight a is large then the ultimate signal 500 output by mixer 5 will be heavily influenced by the signal originating from time-domain processor 3; if the value associated with weight b is large then the output 500 generated by mixer 5 will be heavily influenced by the signal generated by frequency-domain processor 2. This mixing of both signal types allows techniques envisioned by the present invention to take advantage of the benefits offered by both as the scaling factor changes.

In a further example, suppose a user of device 1 wishes to slow down the speed of a sound signal. To do so, she would normally increase the scaling factor. According to the present invention, such an increase in the scaling factor affects the weights a and b. More particular, such an increase results in an increase in weight b and a decrease in weight a. This leads to an output sound signal 500 which is influenced more by a signal generated by the frequency-domain processor 2 than one generated by the time-domain processor 3.

In one simplified embodiment of the concepts just discussed, device 1 is adapted to adjust weights a and b only when an input sound signal transitions from a speech to a music signal or vice-versa. For example, if a speech signal is detected, a "full" weight is assigned to the first signal (e.g., a=1; b=0); while if music is detected, the full weight is assigned to the second signal (e.g., a=0, b=1). In these special cases, when one of the weights is equal to zero, no processing by the respective processor occurs (e.g., when a=0, b=1 no time-domain processing occurs, only frequency domain processing). This may occur when the input signal comprises substantially speech or music. In sum, the mixer 5 substantially acts as a switch either outputting the time-domain processed or the frequency-domain processed signal (i.e., first or second signal). It should be noted that although the discussion above and below focuses on speech and music-like sound signals, devices envisioned by the present invention will also process other sound signals as well. In such a case the input signal is classified as either a speech or music signal (i.e., if the signal is more speech-like, then it is classified as speech; otherwise, it is classified as a music signal).

The special case described above requires only a limited amount of synchronization (i.e., delay matching) between the time and frequency-domain processed signals, namely, at the transitions from speech to music and vice-versa. It should be understood, however, that in other embodiments of the present invention (i.e., where a and b are both non-zero) synchronization has to be performed almost constantly.

In addition to utilizing both time and frequency-domain processed signals, the present invention envisions further improvement of a time-scaled (i.e., speed adjusted) output sound signal by treating stationary and non-stationary signal portions differently and by using an adaptive frame-size.

In one embodiment of the present invention, processors 2,3 are adapted to detect whether an instantaneous input sound signal comprises a stationary or non-stationary signal. If a non-stationary signal is detected, then time-scaling sections 22,32 within processors 2,3 are adapted to selectively withhold time-scaling (i.e., these signal portions are not time-scaled). In other words, only stationary portions are selected to be time-scaled.

By selecting stationary signal portions for time-scaling and not non-stationary portions, the original characteristics of "impulsive" sounds and "onset" sounds (both of which are non-stationary) are maintained. This is important in order to generate time-scaled speech which sounds original in nature to a listener.

Though sections 22,32 do not apply time-scaling to non-stationary signal portions they are nonetheless adapted to process non-stationary signal portions using alternative processes such that the signals generated comprise characteristics which are substantially similar to an input sound signal.

As briefly mentioned above, devices envisioned by the present invention also make use of an adaptive frame size. In general, the frame-size determines how much of the input signal will be processed over a given period of time. The frame-size is typically set to a range of a few milliseconds to some tens of milliseconds. It is desirable to change the frame-size depending on the stationary nature of the signal.

Referring back to FIG. 1, frequency-domain processor 2 comprises a frame-size section 21. The frame-size section 21 is adapted to generate a frame-size based on the stationary and non-stationary characteristics of an input music signal or the like. That is, when the signal input via pathway 100 is a music signal, the frame-size section 21 is adapted to detect both the stationary and non-stationary portions of the signal. The frame-size section 21 is further adapted to generate a shortened frame-size to process the non-stationary portion of the signal and to generate a lengthened frame size to process the stationary portion. This variable frame-size is one example of what is referred to by the inventor as an adaptive frame-size.

At substantially the same time that the adaptive frame-size is being generated by section 21, the input signal is being processed by a frequency-domain, time-scaled section 22. This section 22 is adapted to generate the time-scaled second signal using techniques known in the art. In addition, however, according to the present invention, section 22 is influenced by a scaling factor input via pathway 101. The resulting signal is sent to a delay section 23 which is adapted to add a delay to the second signal and to process such a signal using the adaptive frame-size generated by section 21. It is this processed signal that becomes the second signal which is eventually adjusted by weight b.

As mentioned before, delays are necessary to synchronize the outputs of the time-domain and frequency-domain processors 2,3. Without synchronization, the two signals (time-domain and frequency domain processed signals) would not be aligned in time resulting in an output sound signal 500 which contains an echo. Both time-domain and frequency-domain processors may produce delays that vary over time. For time-domain processing, the delay may vary due to slight, short-term changes in the scaling factor. Although a user may set a target scaling factor, the actual scaling factor at a given moment in time may differ from such a target. To offset such an effect and still achieve a target scaling factor set by a user, sections 22,32 are adapted to time-scale stationary signal portions by an amount slightly greater than a user's target scaling factor. Besides slight short-term variations in the scaling factor, significant short-term variations may also occur during time-domain and frequency-domain processing. For example, sounds such as 't','k','p' may not be scaled at all, while short-term stationary "phonemes", such as 'a','e', 's' may be scaled more to achieve an average scaling factor that equals a target scaling factor.

On the other hand, for frequency-domain processing, the delay period is determined by the frame-size. A short frame-size introduces less delay than a large frame-size. If the outputs of the frequency-domain and time-domain processors 2,3 are mixed using weights a and b that are non-zero, these delays have to match (although a variation of a few milliseconds maybe tolerated, for example, when short-term stationary phonemes are being processed; but note that such variations introduce spectral changes and tend to degrade sound quality).

Referring again back to FIG. 1, the time-domain processor 3 also generates first signal 300 based on an adaptive frame-size. Instead of using the stationary nature of an input signal to adjust a frame-size, pitch characteristics are used. In more detail, time-domain processor 3 comprises: a time-domain, time-scaling section 32 adapted to generate a time-domain, time-scaled signal from the input signal and the scaling factor input via pathway 101; and a time-domain, frame-size section 31 adapted to generate a frame-size based on the pitch characteristics of the input signal. This signal is sent to a delay section or unit 33. Section 33 is adapted to process the signal using a frame-size generated by section 31. Instead of immediately outputting a resulting signal, the delay section 33 is adapted to add a delay in order to generate and output a delayed, time-domain, time-scaled signal (i.e., the first signal referred to above) via pathway 300 substantially at the same time as the second signal is output from frequency-domain processor 2 via pathway 200.

In an alternative embodiment of the present invention, one of the delay units 23,33 is adapted to control the other via pathway 320 or the like to ensure the appropriate delays are utilized within each unit to prevent echoing and the like.

Time-scaled, speed-adjusted signals generated by using an adaptive frame size have lower amounts of reverberation as compared with signals generated using conventional techniques.

Features of the present invention have been illustrated by the examples discussed above. Modifications may be made to these examples without departing from the spirit and scope of the present invention, the scope of which is determined by the claims which follow:

We claim:

1. A device for selectively generating time-scaled sound signals comprising:

a control unit adapted to generate first and second weights from an input sound signal;

a time-domain processor adapted to generate a time-domain processed, time-scaled signal ("first signal");

a frequency-domain processor adapted to generate a frequency-domain processed, time domain, time-scaled signal ("second signal") using an adaptive frame-size based on stationary and non-stationary characteristics of the input sound signal; and a mixer adapted to adjust the first signal using the first weight, adjust the second signal using the second weight, combine the adjusted signals and output a time-scaled, sound signal.

2. The device as in claim 1 wherein the control unit is further adapted to adjust the first and second weights based on a scaling factor.

3. The device as in claim 2 wherein the control unit is further adapted to increase the first weight and decrease the second weight as the scaling factor increases.

4. The device as in claim 1 wherein the control unit comprises a sound discriminator adapted to detect whether the input sound signal is substantially a music or speech signal.

5. The device as in claim 1 wherein the frequency domain processor is adapted to generate a shortened frame-size for non-stationary portions of the input signal and to generate a lengthened frame-size for stationary portions of the input signal.

6. The device as in claim 1 wherein the frequency-domain processor is further adapted to generate a time-scaled signal only for stationary signal portions of the input signal.

7. The device as in claim 6 wherein the frequency-domain processor is further adapted to generate a second signal for non-stationary signal portions of the input signal which has substantially the same characteristics as the input signal.

8. The device as in claim 1 wherein the frequency-domain processor comprises a delay section adapted to add a delay to the second signal.

9. The device as in claim 1 wherein the time-domain processor is further adapted to output the first signal using an adaptive frame size based on pitch characteristics of the input sound signal.

10. The device as in claim 9 wherein the time-domain processor further comprises a pitch detector adapted to detect the pitch characteristics of the input sound signal.

11. The device as in claim 1 wherein the time-domain processor comprises a delay section adapted to add a delay to the first signal.

12. The device as in claim 1 wherein each of the processors comprises a delay section, wherein one of the delay sections is adapted to control a delay generated by the other delay section.

13. The device as in claim 1 wherein the mixer is further adapted to output a first signal when the input sound signal comprises substantially speech only.

14. The device as in claim 1 wherein the mixer is further adapted to output a second signal when the input sound signal comprises substantially music only.

15. A method for generating time-scaled sound signals comprising:

generating first and second weights from an input sound signal;

generating a time-domain processed, time-scaled signal ("first signal");

generating a frequency-domain processed, time-domain, time-scaled signal ("second signal") using an adaptive frame-size based on stationary and non-stationary characteristics of the input sound signal;

adjusting the first signal using the first weight;

adjusting the second signal using the second weight;

combining the adjusted signals; and outputting a time-scaled, sound signal.

16. The method as in claim 15 further comprising adjusting the first and second weights based on a scaling factor.

17. The method as in claim 16 further comprising increasing the first weight and decreasing the second weight as the scaling factor increases.

18. The method as in claim 15 further comprising detecting whether the input sound signal is substantially a music or speech signal.

19. The method as in claim 15 further comprising generating a shortened frame size for non-stationary characteristics and generating a lengthened frame-size for stationary characteristics.

20. The method as in claim 15 further comprising generating a time-scaled signal only for stationary portions of the input sound signal.

21. The method as in claim 20 further comprising generating a second signal for the non-stationary portions of the input sound signal which has substantially the same characteristics as the input signal.

22. The method as in claim 15 further comprising adding a delay to the first signal.

23. The method as in claim 15 further comprising generating a frame-size based on pitch characteristics of the input sound signal.

24. The method as in claim 15 further comprising adding a delay to the second signal.

25. The method as in claim 15 further comprising controlling delays added to the first and second signals to ensure the signals are substantially synchronized.

26. The method as in claim 15 further comprising outputting a first signal when the input sound signal comprises substantially speech only.

27. The method as in claim 15 further comprising outputting a second signal when the input sound signal comprises substantially music only.

* * * * *